United States Patent [19]

Yoshioka et al.

[11] 4,359,982

[45] Nov. 23, 1982

[54] THROTTLE VALVE OPENING CONTROLLER

[75] Inventors: Mamoru Yoshioka; Takao Tate, both of Susono, Japan

[73] Assignee: Toyota Jidosha Kogyo Kabushiki Kaisha, Aichi, Japan

[21] Appl. No.: 171,816

[22] Filed: Jul. 24, 1980

[30] Foreign Application Priority Data

Aug. 1, 1979 [JP] Japan ..... 54-98806

[51] Int. Cl.[3] ..... F02D 33/02

[52] U.S. Cl. ..... 123/320; 123/340; 123/DIG. 11; 261/DIG. 18; 261/DIG. 19

[58] Field of Search ..... 123/389, 320, 328, 378, 123/DIG. 11, 340; 261/DIG. 18, DIG. 19

[56] References Cited

U.S. PATENT DOCUMENTS 4,060,063 11/1977 Hirasawa ..... 123/328
4,104,337 8/1978 Garcea ..... 123/328 X
4,142,676 3/1979 Hattori ..... 236/101 R
4,144,852 3/1979 Kawai et al. ..... 123/320
4,168,681 9/1979 Kawai et al. ..... 123/DIG. 11

*Primary Examiner*—William A. Cuchlinski, Jr.
*Attorney, Agent, or Firm*—Stevens, Davis, Miller & Mosher

[57] ABSTRACT

A throttle valve opening controller for applying variable retarding forces against the closing force of the throttle valve at the time of quick closing thereof depending on the running condition of the engine, comprising: a diaphragm device consisting of a diaphragm which is movable in association with the throttle valve when the throttle valve opening is smaller than the specified value, a spring for urging said diaphragm with a force smaller than the closing force of the throttle valve, and a diaphragm chamber which is formed on the rear side of said diaphragm and to which atmospheric pressure or intake vacuum immediately downstream of the throttle valve is admitted; and means for varying the leak rate of the air discharged from the diaphragm chamber of said diaphragm device at the time of quick closing of the throttle valve depending on the running condition of the engine.

7 Claims, 7 Drawing Figures

THROTTLE VALVE OPENING CONTROLLER

BACKGROUND OF THE INVENTION

1. Field of the Invention

The present invention relates to a throttle valve opening controller for applying retarding forces against the closing force of the throttle valve at the time of quick closing thereof. More particularly, this invention relates to an improved throttle valve opening controller, which is suitable for use in internal combustion engines of automobiles equipped with exhaust gas purifying devices, and is provided with a diaphragm device consisting of a diaphragm which is movable in association with the throttle valve when the opening of said throttle valve is smaller than the specified value, a spring for urging said diaphragm with a force smaller than the closing force of the throttle valve, and a diaphragm chamber which is formed in the rear of said diaphragm and to which atmospheric pressure or intake vacuum immediately downstream of the throttle valve is admitted.

2. Description of the Prior Art

Generally, injurious exhaust gases from internal combustion engines, such as automobile engines, include hydrocarbons (HC), carbon monoxide (CO), and oxides of nitrogen (NOx). Of these exhaust components, hydrocarbons are formed as a result of incomplete combustion, flame suppression at inner wall surfaces of the combustion chambers or misfire. In particular, when the throttle valve is closed fully and quickly at the time of engine brake application or for any other reasons, the negative pressure in the intake pipe increases abruptly, and therefore the fuel adhering to the intake manifold evaporates quickly and the evaporated fuel is sucked into the combustion chamber of the engine in large quantities. In addition, as the absolute amount of air being sucked becomes insufficient, ignition becomes inferior, resulting in a misfire or near-misfire. Under this condition, unburned fuel is discharged as hydrocarbons in large quantities. To prevent the emission of hydrocarbons when the engine brake is applied, deceleration control devices, such as throttle positioner and dash pot, have been proposed. These devices are designed to reduce the formation of hydrocarbons through the improvement of combustion and the prevention of misfire by preventing the air-fuel mixture from becoming too rich and maintaining a certain amount of air-fuel mixture at the time of deceleration.

As shown in FIG. 1, such a device comprises, for example, a diaphragm device 18 which is designed to apply retarding forces against the closing force of a throttle valve 16 disposed downstream of a venturi 14 in an intake passage 12 of a main body of carburetor 10 at the time of quick closing thereof. This diaphragm device consists of a diaphragm 18*a* which is in abutting contact with a throttle valve lever 17 rotatable together with the throttle valve 16 through a rod 24 at the tip thereof and is movable in association with the throttle valve 16 when the opening of the throttle valve 16 is smaller than the specified value, a compression spring 18*c* for urging said diaphragm 18*a* with a force smaller than the closing force of the throttle valve, and a diaphragm chamber 18*b* which is formed in the rear of said diaphragm 18*a* and to which atmospheric pressure is admitted from an air port 22 disposed upstream of the venturi 14 through a pressure transmitting valve (hereinafter referred to briefly as PTV) 20. The PTV 20 has a check valve 20*a* and an orifice 20*b* which are connected to each other in parallel. The check valve 20*a* is arranged in such a direction that the atmospheric pressure admitted from the air port 22 can be rapidly transmitted to the diaphragm chamber 18*b* of the diaphragm device 18. In FIG. 1, numeral 26 designates an air cleaner for admitting clean air to the intake passage 12, while numeral 28 indicates an intake manifold for distributing and supplying the air-fuel mixture produced in the main body of carburetor 10 to the combustion chambers of the engine.

In conventional deceleration control devices as described above, when the engine is stopped, the force of the return spring of the throttle valve 16 for applying the closing force to said throttle valve 16 is larger than the force of the compression spring 18*c* of the diaphragm device 18. Accordingly, the rod 24 is pushed back to the right in FIG. 1 by the throttle valve lever 17, overcoming the force of the compression spring 18*c*, thus keeping the throttle valve 16 in the fully closed condition or in the specified idling opening. When the engine is operated, the throttle valve 16 is opened in association with the accelerator not shown. Under this condition, the throttle valve lever 17 is disengaged from the rod 24 and the rod 24 is pushed forward to the specified position by the actions of the compression spring 18*c* and the air admitted quickly to the diaphragm chamber 18*b* through the air port 22 and the PTV 20. If the accelerator is suddenly closed at the time of deceleration or for any other reasons and a closing force is applied to the throttle valve 16, the throttle 16 is turned in the closing direction by the force of the return spring thereof. When the opening of the throttle valve 16 has been decreased to such an extent that the throttle valve lever 17 reaches the position where it comes into abutting contact with the rod 24, a retarding force is applied to the throttle valve lever 17 of the throttle valve 16 through the rod 24 by the actions of the compression spring 18*c* and the air pressure accumulated in the diaphragm chamber 18*b*. Accordingly, the quick closing of the throttle valve 16 is prevented, and the throttle valve 16 is closed progressively by the force of the return spring of the throttle valve 16 which overcomes the force of the compression spring 18*c* and the air pressure in the diaphragm chamber 18*b*. At this time, the operating characteristics of the diaphragm 18*a* of the diaphragm device 18, i.e., the opening control of the throttle valve 16 is dependent upon the conditions of the air which flows backward toward the air port 22 from the diaphragm chamber 18*b* of the diaphragm device 18 through the orifice 20*b* of the PTV 20. As the quick closing of the throttle valve 16 is prevented by the diaphragm device 18 as described above, the sudden increase in negative pressure in the intake manifold 28 is prevented and a certain ratio of air-fuel mixture is secured. As a result, combustion is improved and misfire is prevented, thus reducing the formation of hydrocarbons.

In internal combustion engines, on the other hand, the opening of the throttle valve to be maintained at the time of deceleration varies with the running conditions in general. For example, the frictional forces to be developed in the internal combustion engine in the cold state differs from that in the warmed-up engine even if the throttle valve opening is the same. Accordingly, the performance of engine brake is varied. And in the internal combustion engines provided with a catalytic converter as an exhaust purifying device in the exhaust system, the formation of hydrocarbons should be reduced by increasing the opening of the throttle valve maintained at the time of deceleration when the engine is in the cold state and a temperature of the catalytic converter has not reached a level at which its purifying performance is fully exhibited. After the engine has been sufficiently warmed up to a temperature level at which the catalytic converter fully exhibits the purifying performance, it is desirable to leave the reduction of exhaust of hydrocarbons to the catalytic converter and to decrease the throttle valve opening in order to prevent increased fuel cost and improve the enging brake performance, thereby improving the running performance of the vehicle.

With conventional deceleration control devices, however, the operating characteristics of the diaphragm device are the same, regardless of the running conditions of the engine and these devices have a disadvantage that the problems of the running performance of the vehicle, exhaust gas purification and fuel cost are not sufficiently solved either in the cold state or in the warmed-up condition of the engine.

SUMMARY OF THE INVENTION

This invention has been developed to obviate the drawbacks of conventional devices as described above. It is the object of this invention to improve the running performance of the engine, exhaust gas purifying performance, and fuel cost by providing a throttle valve opening controller which can obtain the most suitable valve opening depending on the running condition of the engine.

The abovedescribed object has been accomplished in that, according to the present invention, the throttle valve opening controller for applying retarding forces against the closing force of the throttle valve at the time of quick closing thereof, comprises a diaphragm device consisting of a diaphragm which is movable in association with the throttle valve when the throttle valve opening is smaller than the specified value, a spring for urging said diaphragm with a force smaller than the closing force of the throttle valve, and a diaphragm chamber which is formed on the rear side of said diaphragm and to which atmospheric pressure or intake vacuum immediately downstream of the throttle valve is admitted, wherein means is provided for varying the leak rate of air discharged from the diaphragm chamber of said diaphragm device at the time of quick closing of the throttle valve depending on the running condition of the engine.

Or, said means for varying the leak rate is formed into a bypass path provided therein with an orifice and an on-off valve for bypassing a PTV for introducing atmospheric pressure or intake vacuum into said diaphragm chamber.

Or, said means for varying the leak rate is formed into a switching valve for switching and communicating either one of the PTVs provided in parallel to each other and different in leak rate from each other with said diaphragm chamber.

Or, said means for varying the leak rate is formed into a bypass path provided therein with an orifice and a switching valve for bypassing a PTV for introducing atmospheric pressure into said diaphragm chamber.

BRIEF DESCRIPTION OF THE DRAWINGS

The abovementioned features and object of the present invention will become more apparent with reference to the following description taken in conjunction with the accompanying drawings, wherein like reference numerals denote like elements, and in which.

DETAILED DESCRIPTION OF THE INVENTION

Figure 1:
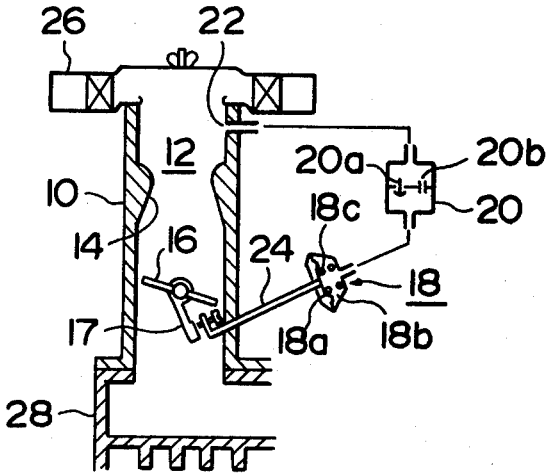
FIG. 1 is a block diagram showing one example of the dash pot type throttle valve opening controller.

Description will hereunder be given of the embodiments of the present invention with reference to the drawings. As shown in FIG. 1, the first embodiment of the present invention is of such an arrangement that, in a deceleration controller comprising a diaphragm device 18 and a PTV 20 that are similar to the conventional ones, a bypass path 30 for bypassing said PTV 20, and said bypass path 30 is provided therein with a temperature sensing valve 34 adapted to sense the temperature of an engine coolant 32 to be opened or closed, and an orifice 36. The other points are similar to the conventional example as described above, and hence, detailed description will be omitted.

Said temperature sensing valve 34 comprises: a bimetal **34*a* for sensing the temperature of the engine coolant 32 to operate; and a valve body 34*b* for closing said bypass path 30 when the temperature of the engine coolant 32 is below the specified value and opening the bypass path 30 when the temperature of the engine coolant 32 is elevated beyond the specified value, by the movement of the bimetal 34*a*. Said temperature sensing valve 34 is threadably coupled to an engine block 38** for example.

In addition, the diameter of an orifice **20*b* of said PTV 20 or the diameter of the orifice 36 may be suitably selected in accordance with the operating characteristics of the diaphragm device 18** required while the engine is cold and in accordance with the operating characteristics of the diaphragm required after the engine has been warmed up, respectively.

Figure 2:
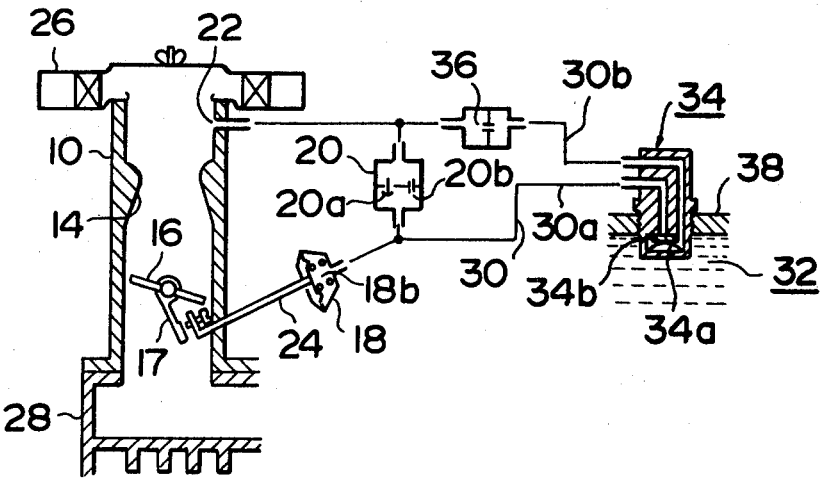
FIG. 2 is a block diagram showing the condition of the engine at the cold state in a first embodiment of the throttle valve opening controller according to the present invention.

Description will hereunder be given of action. Firstly, in a condition where the temperature of the engine coolant 32, while the engine is cold, is lower than the specified value and, as shown in FIG. 2, the valve body **34*b* is disposed at an upper position and the bypass path 30 is closed by the temperature sensing valve 34, a diaphragm 18*a* of the diaphragm device 18 is operated by the leak characteristics of air in a diaphragm chamber 18*b* of the diaphragm 18 determined by the orifice 20***b* of the PTV 20 as in the conventional way. In consequence, a rod 24 displays slow characteristics suitable for the cold engine state by slowly retracting for the operating time of 4 to 5 sec. for example, and hence, although a catalytic converter functions unsatisfactorily, the quantity of HC produced in combustion chambers of the engine is reduced to a considerable extent, thus enabling to obtain satisfactory exhaust gas purifying characteristics.

Figure 3:
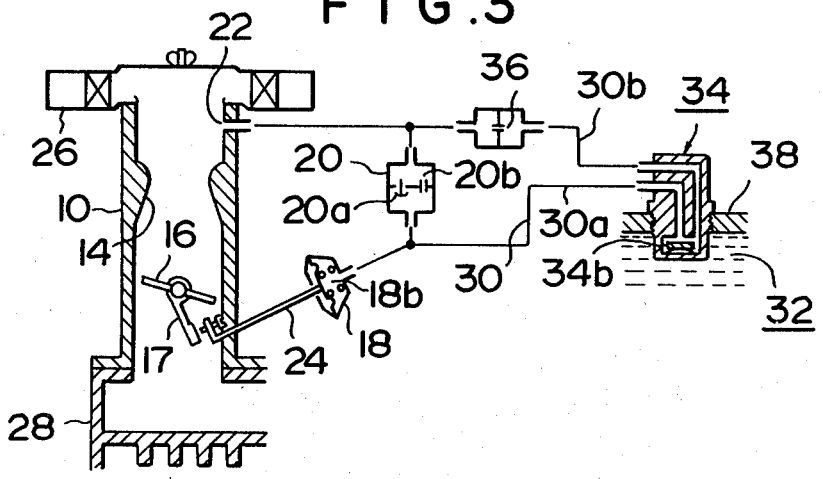
FIG. 3 is a block diagram showing the condition of the engine after the engine has been warmed up in the first embodiment.

While, in the case the temperature of the engine coolant 32 sensed by the temperature sensing valve 34 is elevated beyond the specified value after the engine has been warmed up, as shown in FIG. 3 the valve body 34*b* is lowered and the bypass path 30 is opened by the temperature sensing valve 34. The operating characteristics of the diaphragm 18*a* of the diaphragm device 18 at the time of engine brake application thereby come to be comparatively quick and are determined by the orifice 20*b* of the PTV 20 and the orifice 36 provided in parallel therewith, e.g., one with the working time of about 1 sec. In consequence, the throttle valve 16 is quickly closed, thereby enabling to obtain a satisfactory engine braking performance and fuel consumption rate. In addition, the HC purifying treatment at this time is solely effected by the catalytic converter which has already been warmed up.

Figure 4:
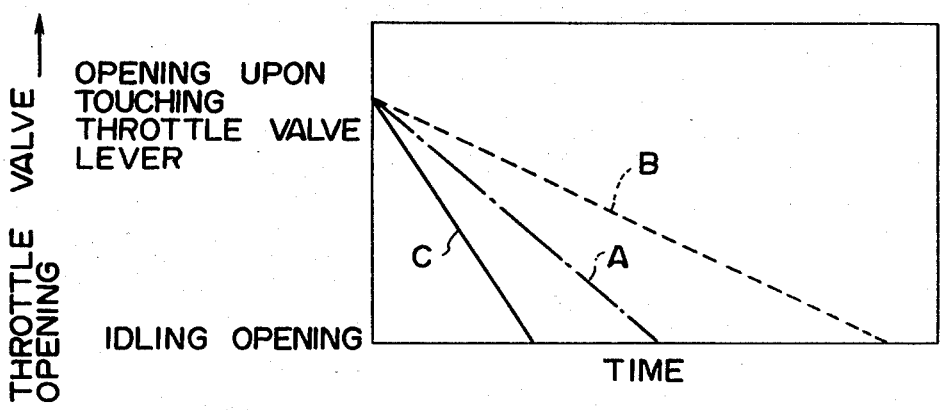
FIG. 4 is a diagram showing the operating characteristics of the throttle valve opening controllers in said first embodiment and in the conventional example.

The closing characteristic of the throttle valve when the throttle valve 16 is quickly closed in the conventional deceleration controller is indicated by a one-dot chain line A in FIG. 4, the closing characteristic of the throttle valve in the first embodiment of the present invention is indicated by a broken line B in FIG. 4, and the closing characteristic of the throttle valve thereof after the engine is warmed up is indicated by a solid line C in FIG. 4.

Figure 5:
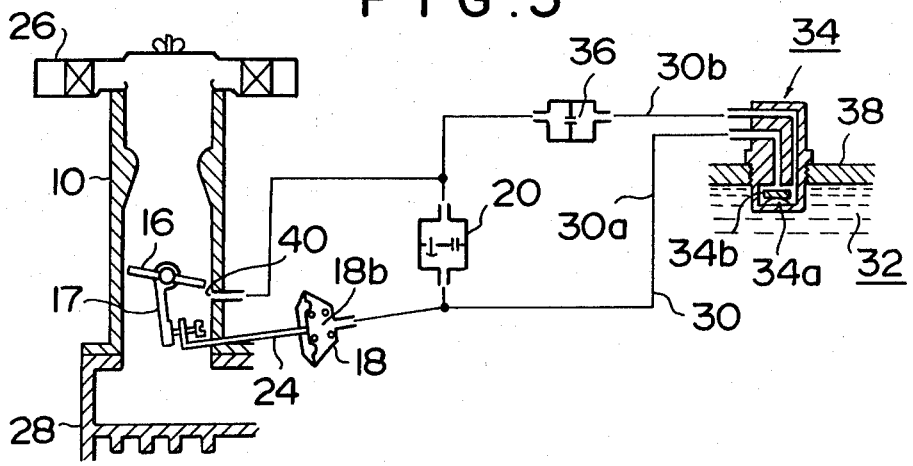
FIG. 5 is a block diagram showing the arrangement of a second embodiment of the throttle valve opening controller according to the present invention.

FIG. 5 shows a second embodiment of the present invention. This embodiment differs from said first embodiment in that the PTV 20 and the orifice 36 are connected to a vacuum port 40 formed immediately downstream of a throttle valve 16 of the intake passage 12 but not to an air port, and the diaphragm device 18 is operated in accordance with the port vacuum which comes to be close to the intake vacuum when the opening of the throttle valve becomes small and comes to be close to the atmospheric pressure when said opening becomes large. The other points are similar to said first embodiment, and hence, detailed description will be omitted.

In addition, in either one of the abovedescribed embodiments, the orifice 36 is provided independently of the temperature sensing valve 34 or the bypass path 30. However, the orifice 36 may be integrally formed on the temperature sensing valve 34, or the bypass path 30*a* led into the temperature sensing valve 34 and the bypass path 30*b* led out thereof may be formed to provide suitable flow courses, so that the orifice 36 can be incorporated in the bypass path 30*a* or 30*b*.

Figure 6:
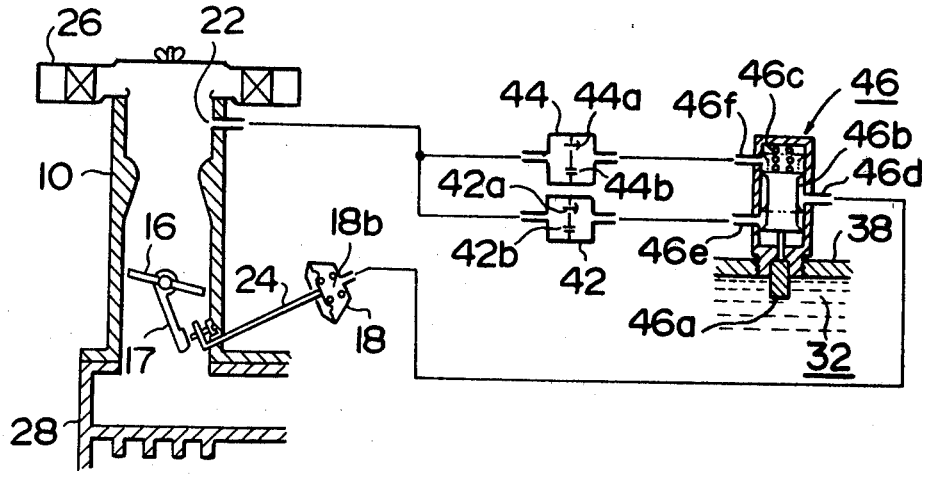
FIG. 6 is a block diagram showing the arrangement of a third embodiment.

FIG. 6 shows a third embodiment of the present invention. This embodiment differs from said first embodiment in that the diaphragm chamber 18*b* of the diaphragm device 18 and the air port 22 are connected to each other through PTVs 42, 44 provided in parallel with each other and the temperature sensing valve 46 connected to said two PTVs 42, 44.

Said temperature sensing valve 46 comprises: a thermowax 46*a* for sensing the temperature of the engine coolant 32; a valve body 46*b* for being movable vertically in the drawing in accordance with expansion or contraction of said thermowax 46*a*; and a compression spring 46*c* for constantly urging said valve body 46*b* downward in the drawing, and is adapted to transmit the atmospheric pressure introduced into the central portion of said valve body 46*b* through a port 46*d* to said PTV 42 through a port 46*e* while the engine is cold during which the thermowax 46*a* is shrunk, and to transmit the atmospheric pressure to said PTV 44 through a port 46*f* after the engine has been warmed up, when the thermowax 46*a* is expanded. Said PTVs 42, 44 are provided therein with check valves 42*a*, 44*a* and orifices 42*b*, 44*b*, respectively. Said PTVs 42, 44 functions respectively while the engine is cold and after the engine has been warmed up, and the diameters of orifice 42*b*, 44*b* thereof are selected to meet with the operating characteristics of the diaphragm 18*a* of the diaphragm device 18 while the engine is cold and after the engine has been warmed up, respectively.

In this embodiment also, the atmospheric pressure in the diaphragm chamber 18*b* of the diaphragm device 18 is leaked to the air port 22 through the PTV 42 or 44 in accordance with the warmed-up state of the engine sensed by the temperature sensing valve 46, so that the opening characteristics of the throttle valve 16 suitable for the cold state or the warmed-up state of the engine, respectively, may be obtained.

Figure 7:
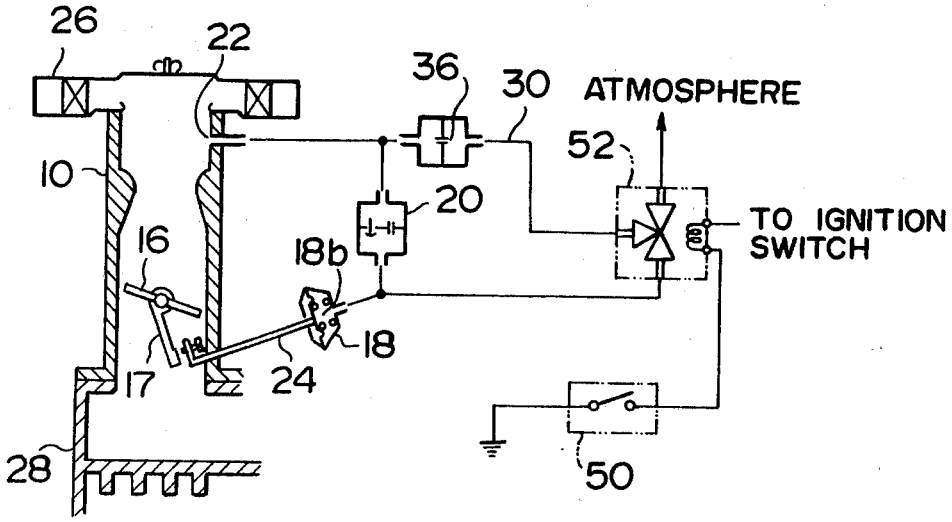
FIG. 7 is a block diagram showing the arrangement of a fourth embodiment.

FIG. 7 shows a fourth embodiment of the present invention. This embodiment differs from said first embodiment in that a pressure switching valve (PSV) 52 adapted to be opened or closed by a water temperature switch 50 operable in accordance with the temperature of the engine coolant in place of the temperature sensing valve is connected to the bypass path 30.

Said water temperature switch 50 is adapted to sense the temperature of the engine coolant, emit an "OFF" signal when the temperature of the engine coolant is below the specified value, and emit "ON" signal when the temperature of the engine coolant is over the specified value.

Furthermore, said PSV 52 is adapted to operate in accordance with said water temperature switch 50 and an ignition switch, open the bypass path 30 after the engine has been warmed up, when both the ignition switch and the water temperature switch 50 are "ON", and introduce the atmospheric pressure to the bypass path 30 on the side of the orifice 36 when at least either one of the water temperature switch 50 or the ignition switch is "OFF". The other points are similar to said first embodiment, and hence, the description in detail will be omitted.

In addition, in either one of the abovedescribed embodiments, the operating characteristics of the diaphragm device are variable in accordance with the temperature of the engine coolant. However, the running condition of the engine for varying the operating characteristics of the throttle valve position restricting means comprising a diaphragm device and the like is not limited to the above but may be suitably changed in accordance with the temperature of the main body of engine, the oil temperature, the ambient temperature, the period of time after the engine has been started, or the shift position of the transmission, or the vehicle speed.

From the foregoing description, it should be apparent to one skilled in the art that abovedescribed embodiment is but one of many possible specific embodiments which can represent the applications of the principles of the present invention. Numerous and varied other arrangements can be readily devised by those skilled in the art without departing from the spirit and scope of the invention.

What is claimed is:

1. In a throttle valve opening controller for applying retarding forces against the closing force of the throttle valve when the throttle valve is quickly closed, comprising:

a diaphragm device consisting of a diaphragm which is movable in association with the throttle valve when the throttle valve opening is smaller than a specified value, a spring for urging said diaphragm against the closing force of the throttle valve with a force smaller than said closing force, and a diaphragm chamber which is formed on the rear side of said diaphragm and to which atmospheric pressure is admitted through a pressure transmitting valve; and means for varying the leak rate of air discharged from the diaphragm chamber of said diaphragm device when the throttle valve is quickly closed, which is selectively activated depending on the running condition of the engine;

the improvement wherein said means for varying the leak rate is a bypass path provided therein with an orifice and an on-off valve for opening or closing the bypass path through which atmospheric pressure can be introduced to said diaphragm chamber simultaneously with the introduction of atmospheric pressure through the pressure transmitting valve.

2. A throttle valve opening controller as set forth in claim 1, wherein said on-off valve is a temperature sensing valve adapted to sense the temperature of the engine coolant, open said bypass path above a specified temperature, and close same below said specified temperature.

3. A throttle valve opening controller for applying retarding forces against the closing force of the throttle valve when the throttle valve is quickly closed, comprising:

a diaphragm device consisting of a diaphragm which is movable in association with the throttle valve when the throttle valve opening is smaller than a specified value, a spring for urging said diaphragm against the closing force of the throttle valve with a force smaller than said closing force, and a diaphragm chamber which is formed on the rear side of said diaphragm and to which atmospheric pressure is admitted through a pressure transmitting valve; and means for varying the leak rate of air discharged from the diaphragm chamber of said diaphragm device when the throttle valve is quickly closed, which is selectively activated depending on the running condition of the engine, wherein said means for varying the leak rate is a bypass path provided therein with an orifice and a temperature sensing on-off valve for opening or closing the bypass path through which atmospheric pressure can be introduced to said diaphragm chamber simultaneously with the introduction of atmospheric pressure through the pressure transmitting valve, said temperature sensing on-off valve comprising a bimetallic element and a valve body, wherein said bimetallic element causes said valve body to close off said bypass path below a specified temperature and causes said valve body to open said bypass path above a specified temperature.

4. A throttle valve opening controller as set forth in claim 3, wherein said bimetallic element is adapted to sense the temperature of the engine coolant.

5. A throttle valve opening controller as set forth in claim 4, wherein said temperature sensing on-off valve is threadably coupled to an engine block.

6. A throttle valve opening controller for applying retarding forces against the closing force of the throttle valve, when the throttle valve is quickly closed, comprising:

a diaphragm device consisting of a diaphragm which is movable in association with the throttle valve when the throttle valve opening is smaller than a specified value, a spring for urging said diaphragm against the closing force of the throttle valve with a force smaller than said closing force, and a diaphragm chamber which is formed on the rear side of said diaphragm and to which atmospheric pressure is admitted through a pressure transmitting valve; and means for varying the leak rate of air discharged from the diaphragm chamber of said diaphragm device when the throttle valve is quickly closed, which is selectively activated depending on the running condition of the engine;

said means for varying the leak rate being a bypass path provided therein with an orifice and an on-off valve for bypassing the pressure transmitting valve for introducing atmospheric pressure to said diaphragm chamber, said bypass path and said pressure transmitting valve both communicating with the atmosphere through a single air port.

7. A throttle valve opening controller for applying retarding forces against the closing force of the throttle valve when the throttle valve is quickly closed, comprising:

a diaphragm device consisting of a diaphragm which is movable in association with the throttle valve when the throttle valve opening is smaller than a specified value, a spring for urging said diaphragm against the closing force of the throttle valve with a force smaller than said closing force, and a diaphragm chamber which is formed on the rear side of said diaphragm and to which atmospheric pressure is admitted through a pressure transmitting valve; and means for varying the leak rate of air discharged from the diaphragm chamber of said diaphragm device when the throttle valve is quickly closed, which is selectively activated depending on the running condition of the engine, wherein said means for varying the leak rate is a bypass path provided therein with an orifice and a temperature sensing on-off valve for bypassing said pressure transmitting valve, said temperature sensing on-off valve comprising a bimetallic element and a valve body, wherein said bimetallic element causes said valve body to close off said bypass path below a specified temperature and causes said valve body to open said bypass path above a specified temperature, and wherein said bypass path and said pressure transmitting valve both communicate with the atmospheric through a single air port.

* * * * *